US006129366A

United States Patent [19]

Dettmann et al.

[11] Patent Number: 6,129,366

[45] Date of Patent: Oct. 10, 2000

[54] MOBILE TEACHING STATION

[75] Inventors: Thomas A. Dettmann, New Prague; Nancy A. Clark, Waseca, both of Minn.

[73] Assignee: Wenger Corporation, Owatonna, Minn.

[21] Appl. No.: 09/209,133

[22] Filed: Dec. 10, 1998

Related U.S. Application Data

[63] Continuation of application No. 09/136,022, Aug. 19, 1998, abandoned

[60] Provisional application No. 60/092,441, Jul. 10, 1998.

[51] Int. Cl.[7] ..... B62B 11/00

[52] U.S. Cl. ..... 280/47.35; 280/659; 434/432

[58] Field of Search ..... 280/47.35, 651, 280/655, 655.1, 47.34, 659, 47.371, 79.2, 79.3, 79.11; 312/249.8, 249.11, 249.12, 249.13, 223.6, 313

[56] References Cited

U.S. PATENT DOCUMENTS

| | | | |
|---|---|---|---|
| 898,778 | 9/1908 | Phelan . | |
| 976,067 | 11/1910 | Gilmore | 312/409 |
| 1,171,343 | 2/1916 | Klok . | |
| 1,654,330 | 12/1927 | Jenkins . | |
| 2,133,127 | 10/1938 | Waterman | 312/208.5 |
| 2,409,348 | 10/1946 | Evans . | |
| 2,555,776 | 6/1951 | Alschuler et al. | 5/2.1 |
| 2,603,500 | 7/1952 | Messier . | |
| 2,852,325 | 9/1958 | Fosnaugh . | |
| 2,981,549 | 4/1961 | Hotton | 280/47.35 |
| 3,722,700 | 3/1973 | Cummings . | |
| 3,849,950 | 11/1974 | Albinson et al. . | |
| 3,861,325 | 1/1975 | Bue et al. . | |
| 3,873,114 | 3/1975 | Brown . | |
| 4,076,349 | 2/1978 | Gettleman et al. | 312/236 |
| 4,478,467 | 10/1984 | Tyndall . | |
| 4,718,741 | 1/1988 | Nichoalds | 312/223.6 |
| 4,782,873 | 11/1988 | Messner et al. | 150/154 |
| 5,152,542 | 10/1992 | DeVoe | 280/47.371 |
| 5,295,743 | 3/1994 | Moulton et al. | 312/297 |
| 5,314,243 | 5/1994 | McDonald | 312/215 |
| 5,464,236 | 11/1995 | Benting et al. . | |
| 5,484,293 | 1/1996 | Fored et al. | 434/432 |
| 5,551,773 | 9/1996 | Cottrell | 312/249.8 |
| 5,611,553 | 3/1997 | Schoeman et al. | 280/47.35 |
| 5,642,898 | 7/1997 | Wise | 280/652 |
| 5,645,332 | 7/1997 | Snoke et al. | 312/257.1 |
| 5,738,423 | 4/1998 | Alfaro | 312/290 |
| 5,848,798 | 12/1998 | Halvorson, Jr. et al. | 280/47.35 |

*Primary Examiner*—Kevin Hurley
*Assistant Examiner*—Andrew J. Fischer
*Attorney, Agent, or Firm*—Patterson, Thuente & Skaar

[57] ABSTRACT

A mobile teaching station includes a mobile teaching surface designed to support a plurality of teaching props during instruction of students. A mobile storage facility for storing the teaching props is disposed proximate the mobile teaching surface and operably coupled thereto. The mobile teaching station further includes devices for readily transporting the mobile teaching surface to a desired teaching site. A method of facilitating mobile teaching of students includes the steps of (a) providing a mobile teaching surface designed to support a plurality of teaching props during instruction of students, (b) providing a mobile storage facility for storing the teaching props proximate the mobile teaching surface and operably coupled thereto, and (c) providing devices for readily transporting the mobile teaching surface to a desired teaching site.

8 Claims, 7 Drawing Sheets

MOBILE TEACHING STATION

RELATED APPLICATIONS

The present application is a continuation of U.S. patent application Ser. No. 09/136,022, filed Aug. 19, 1998, now abandoned and claims benefit to U.S. provisional Ser. No. 60/092,441 filed Jul. 10, 1998.

TECHNICAL FIELD

The invention relates to teaching aids. More particularly, the present invention relates to a teaching aid for facilitating conducting instruction at a plurality of different sites.

BACKGROUND OF THE INVENTION

In the past, a single teacher, particularly a teacher in the primary grades, was assigned to provide instruction in a wide variety of subjects. For such instruction, it worked well to assign that teacher to a single classroom from which virtually all of the instruction delivered by that teacher was made available to students. In recent years, there has been a growing tendency toward specialization of instruction. This is particularly true in the areas of music instruction, art instruction, and science instruction. The providers of such instruction are typically required to move from classroom to classroom in order to address the largest number of students possible. In order to accommodate such mobility, the school administration must stock each classroom in which such instruction is to be given with the necessary teaching props to facilitate the instruction. This specialized instruction typically requires rather expensive teaching props. Accordingly, school administrations have balked at stocking each classroom with such teaching props. This has forced the teachers providing such instruction to become mobile.

In the past, the means for providing such mobility has been makeshift at best. Typically such specialized teachers utilized library carts or utility carts to transport their teaching props from classroom to classroom. Such carts are transportation only and are not designed to provide for delivering instruction from props disposed on the cart. Accordingly, the teacher was required to spend substantial class time first unloading the props from the cart to a suitable teaching surface and second reloading the props onto the cart for transport to a remote teaching site after delivering the instruction.

A further deterrent to using such improvised carts as a teaching station was the lack of electrical power available to such carts. Today, many more teaching props utilized in specialized instruction require electrical power. For example, in the primary grades, music instruction almost universally requires the availability of a portable source of sound delivered from stored media such as what is commonly termed as a "boom box". Additionally, science projects frequently require the use of small electrical motors and other electrical apparati as props for such instruction.

Additionally, there is a need to provide security for the teaching props when they are not being used for instruction. Many of such props, particularly the aforementioned "boom box", are highly pilferable. When using the aforementioned makeshift carts, the highly pilferable items must be removed from the carts at the end of a teaching day and stored in a secure location.

There is a definite need in the teaching profession to provide for a mobile teaching station that is readily movable from classroom to classroom. The mobile teaching station should provide storage for all the teaching props necessary.

The mobile teaching station should further have a teaching surface from which instruction can be delivered without unloading the teaching props from the mobile teaching station. Additionally, electrical power should be readily available when the use of electrically powered teaching props is required. Further, the storage provided in conjunction with the mobile teaching station should be securable during hours when instruction is not being delivered. It should be understood that the need for a mobile teaching station is widespread and has long been vocalized by those teachers having the specialized skills that require classroom-to-classroom mobility. Until the present, no one has stepped forward to meet those needs.

SUMMARY OF THE INVENTION

The mobile teaching station of the present invention substantially meets the aforementioned needs of the industry. The mobile teaching station is readily transportable from classroom to classroom. Storage is provided that is tailored to the specific types of teaching props to be used by the teacher. The mobile teaching station includes a teaching surface that facilitates delivery of instruction to students. Instruction can be delivered utilizing teaching props that are removed from the self-contained storage and placed on the teaching surface. Additionally, the mobile teaching station of the present invention makes provision for supplying electrical power to the mobile teaching station for operation of electrically powered teaching props. Further, after returning the teaching props to their self-contained storage, security panels are available to secure the teaching props and to minimize pilferage.

The present invention is a mobile teaching station including a mobile teaching surface designed to support a plurality of teaching props during instruction of student. At least one source of electric power is available to the mobile teaching surface. A mobile storage facility for storing the teaching props is disposed proximate the mobile teaching surface and operably coupled thereto. The mobile teaching station further includes devices for readily transporting the mobile teaching surface to a desired teaching site. The present invention is further a method of facilitating mobile teaching of students including the steps of (a) providing a mobile teaching surface designed to support a plurality of teaching props during instruction of students, (b) making available at least one source of electric power to the mobile teaching surface, (c) providing a mobile storage facility for storing the teaching props proximate the mobile teaching surface and operably coupled thereto, and (d) providing devices for readily transporting the mobile teaching surface to a desired teaching site.

DETAILED DESCRIPTION OF THE DRAWINGS

Figure 8:
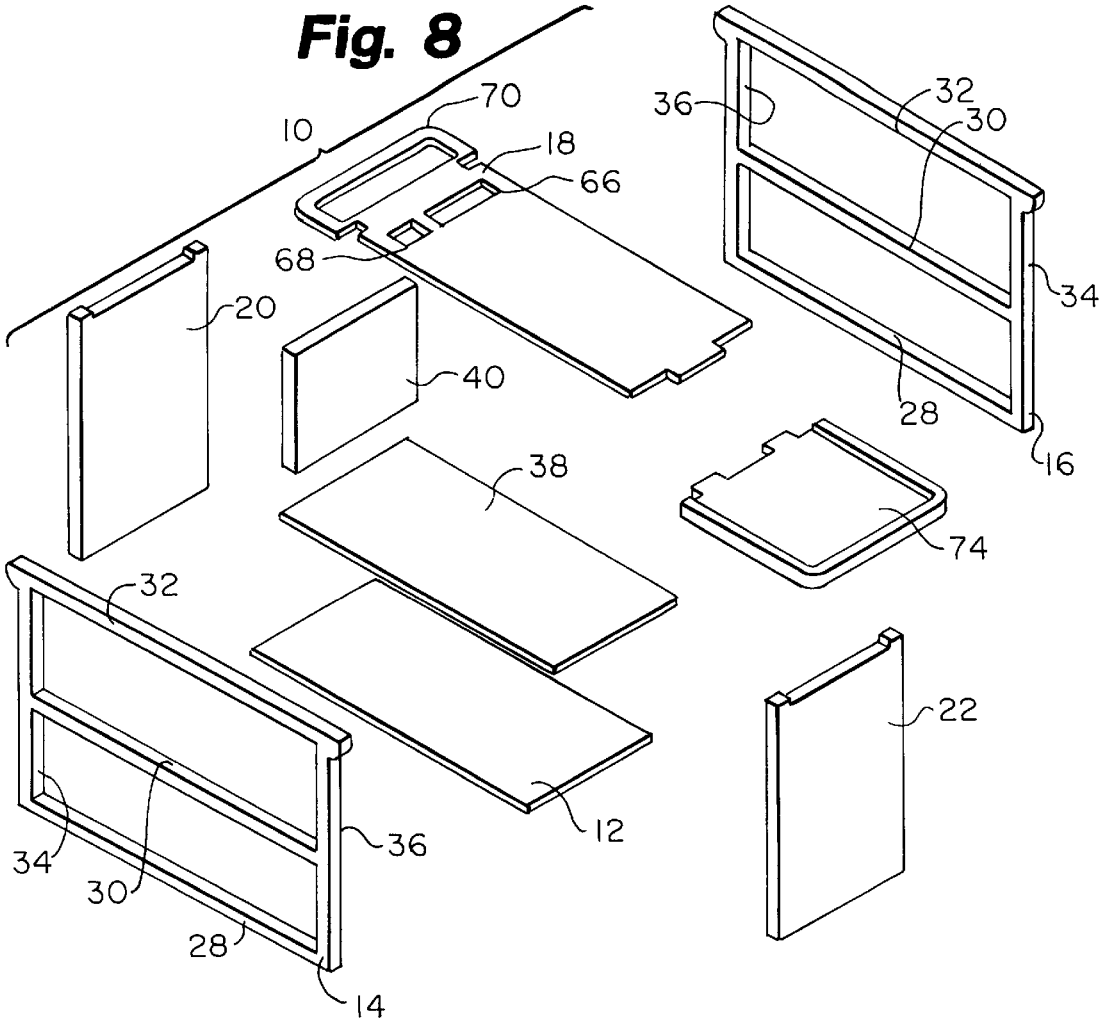
FIG. 8 is an exploded view of the major structural components of the mobile teaching station that are preferably molded.
Figure 9:
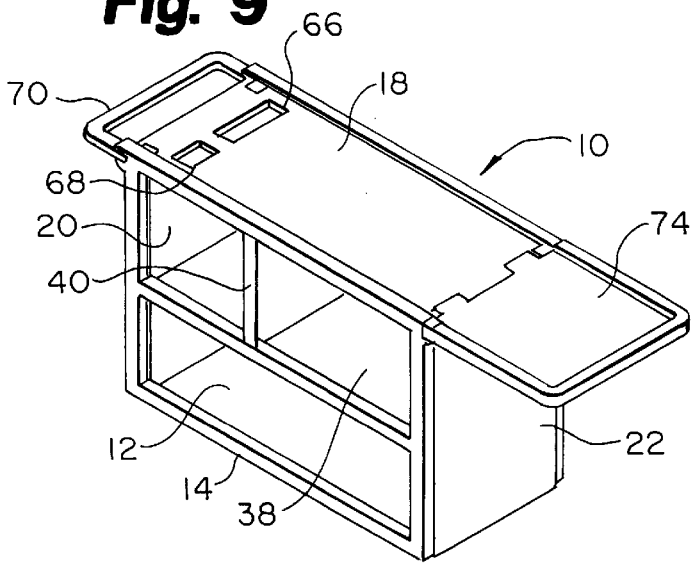
FIG. 9 is a perspective view of the preferably molded components of FIG. 8.

The mobile teaching station of the present invention is shown generally at 10 in the figures. The mobile teaching station 10 is generally defined by a bottom shelf panel 12, opposed side panels 14, 16, teaching surface panel 18 and opposed end panels 20, 22. Referring to FIGS. 8 and 9, preferably, the side panels 14, 16 are identical molded parts and the end panels 20, 22 are identical molded parts.

The bottom shelf panel 12 is preferably a substantially planar, rectangular panel. The bottom shelf panel 12 has two ground-engaging swiveling castors 24 disposed beneath the bottom shelf panel 12 proximate two corners of the bottom shelf panel 12 at a first end of the bottom shelf panel 12. Two ground-engaging, fixed castors 26 are disposed proximate the corners of the bottom shelf panel 12 proximate a second end of the bottom shelf panel 12.

Each of the side panels 14, 16 are formed generally similarly as an integral unit, in a preferred embodiment. The side panels 14, 16 each have a bottom rail 28, a generally parallel center rail 30, and a generally parallel top rail 32. The center rail 30 and the top rail 32 are supported by opposed side rails 34, 36 extending upwardly from the bottom rail 28. The bottom rail 28 is operably coupled to the bottom shelf panel 12.

The center rail 30 is disposed approximately midway between the bottom rail 28 and the top rail 32. The center rail 30 is operably coupled to and supportive of a center shelf panel 38. The center shelf panel 38 extends generally from end-to-end and from side-to-side of the mobile teaching station 10, having generally the same dimensions as the bottom shelf panel 12. The center shelf panel 38 supports a transversely disposed vertical shelf support 40.

The vertical shelf support 40 extends between the center shelf panel 38 of the teaching surface panel 18. The vertical shelf support 40 supports a short shelf panel 42. The short shelf panel 42 extends generally horizontally from the vertical shelf support 40 to the end panel 22. The short shelf panel 42 defines in part an upper and lower storage space 44, 46. The upper and lower storage spaces 44, 46 are each designed to store bins 48. The bins 48 may be slidably removed from the respective upper and lower storage spaces 44, 46 from either the front or the rear of the mobile teaching station 10. A further storage space 50 is defined between the vertical shelf support 40 and the end panel 20. The storage space 50 is designed specifically with dimensions that are able to store the majority of "boom boxes" on the market at the present time.

Figure 4:
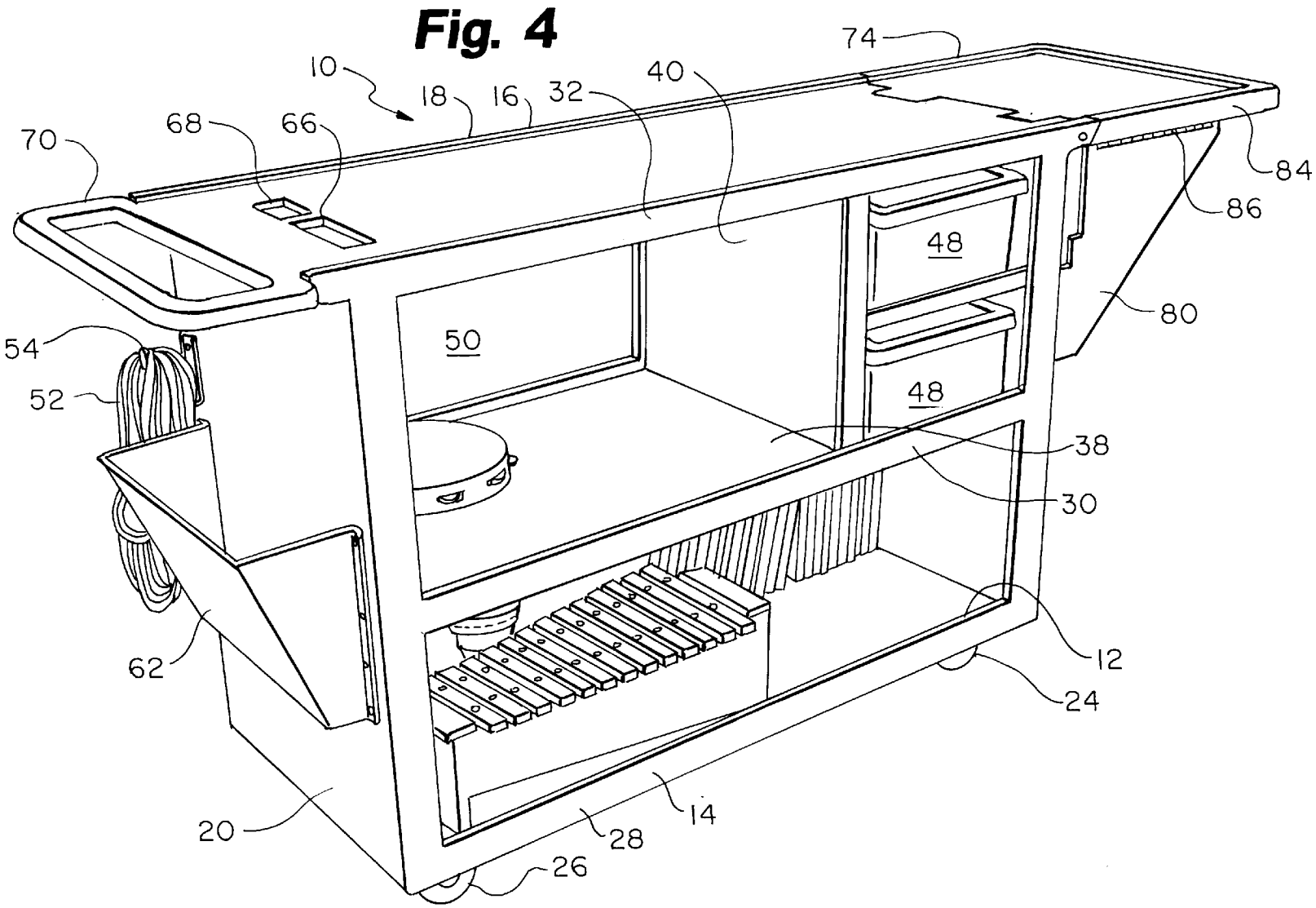
FIG. 4 is a rear prospective view of the mobile teaching station.
Figure 5:
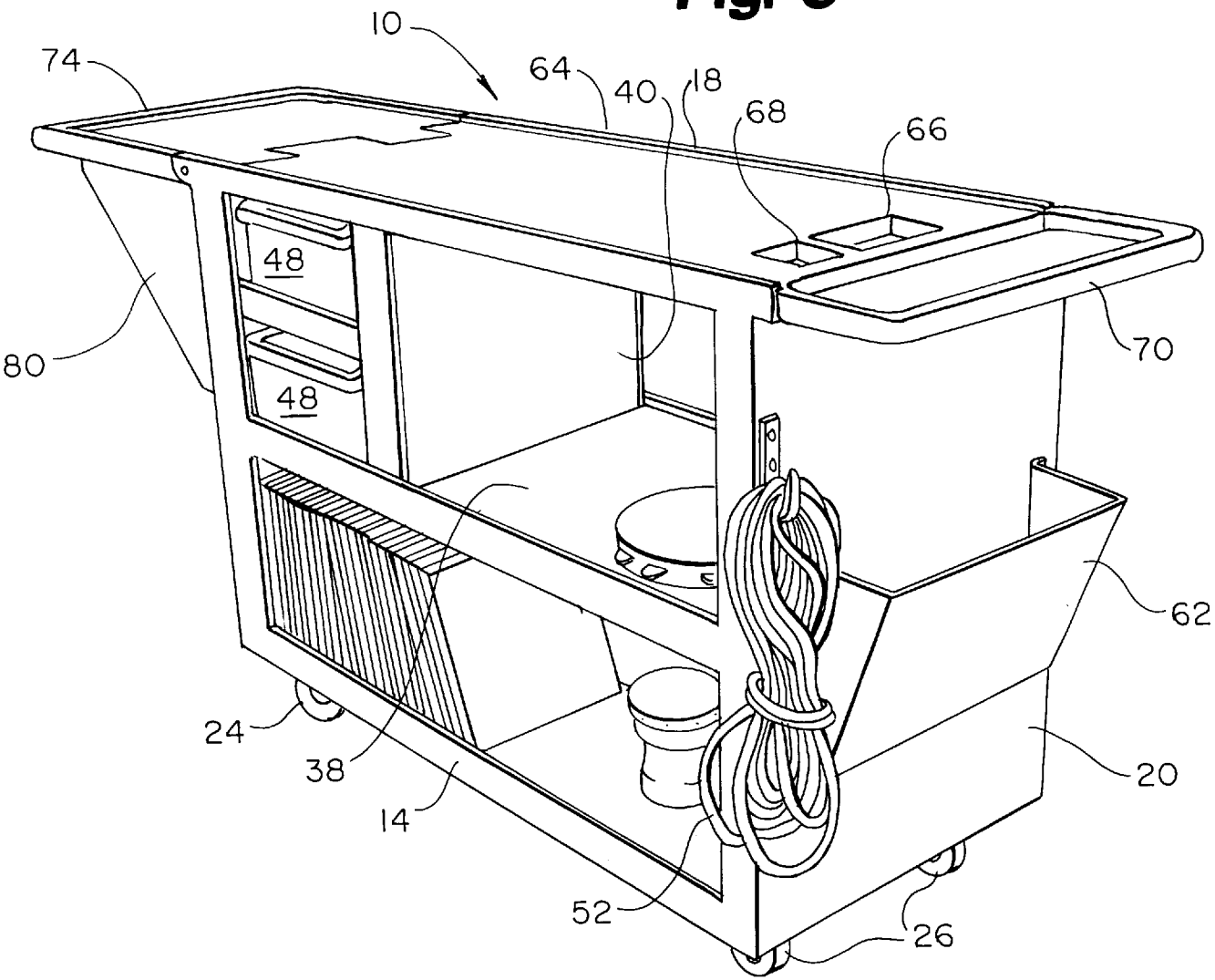
FIG. 5 is a front perspective view of the mobile teaching station.
Figure 6:
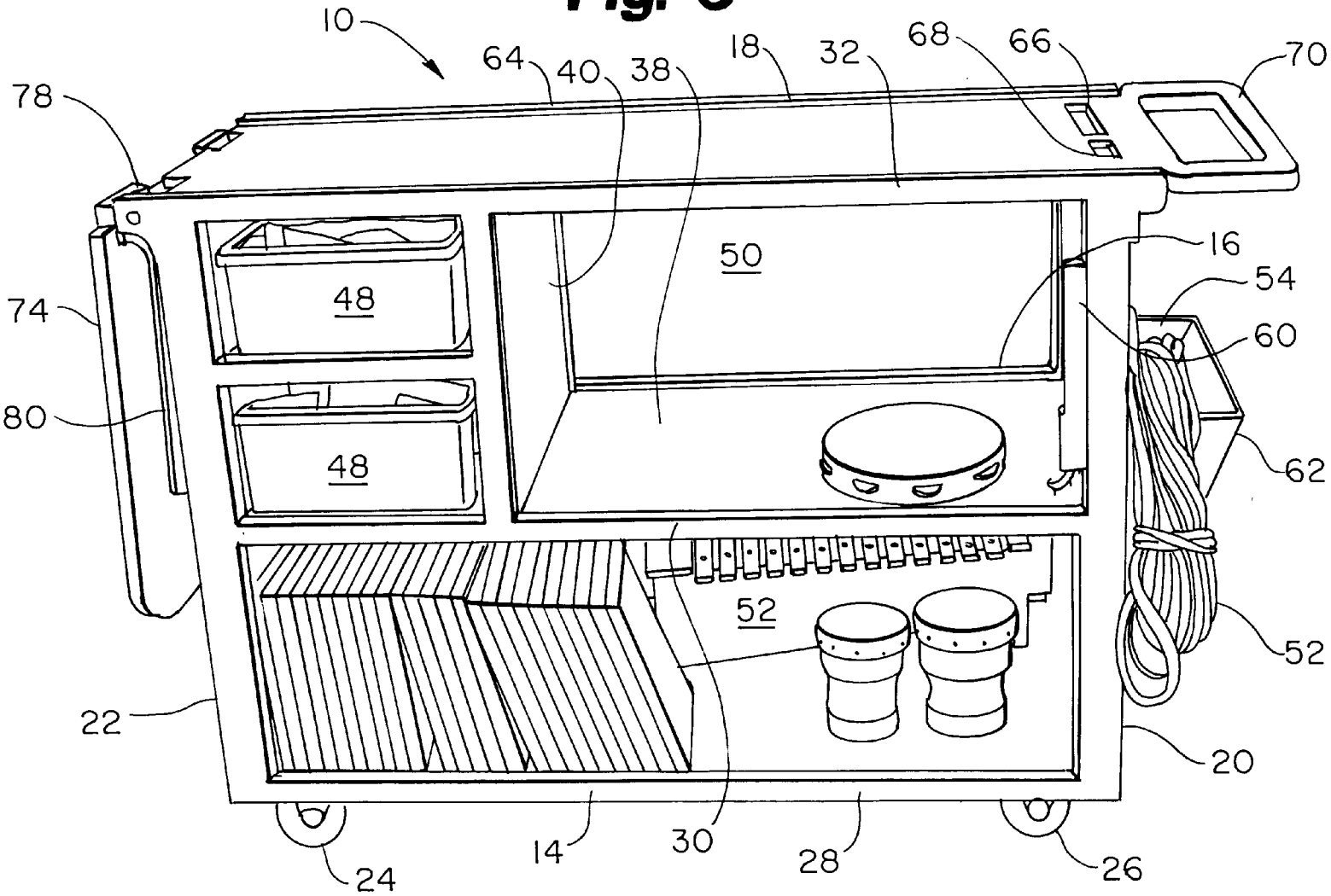
FIG. 6 is a front elevational view of the mobile teaching station.

A third storage space 52 is defined beneath the center shelf panel bounded by the bottom shelf panel 12 and the two side panels 14, 16. As depicted in FIGS. 4–6, the storage space 52 is designed to hold a plurality of textbooks and may also store percussion instruments when the mobile teaching station 10 is used for music instruction.

The side panel 14 includes a J hook 54 on the outer surface of the side panel 14. The J hook 54 is upwardly directed. The hook 54 is designed to store a looped power cord 56 as depicted in FIGS. 4–6. An end of power cord 56 is electrically coupled to a power strip 60 mounted on the inner surface of the side panel 14. An inclined storage bin 62 is fixedly coupled to the outside surface of the side panel 14 adjacent to the power cord 56.

The teaching surface panel 18 of the mobile teaching station 10 comprises the upper structural member of the mobile teaching station 10. Further, the upper surface 64 of the teaching surface panel 18 provides a generally planar surface upon which teaching props may be supported while instruction is being provided. The upper surface 64 of the teaching surface panel 18 is disposed at a suitable height above the underlying ground surface to facilitate delivery of instruction from upper surface 64. The height is selected to allow an average height person to readily remove teaching props from the upper and lower storage spaces 40, 42, the storage space 50 , and the storage space 52, place the teaching props on the upper surface 64 and deliver a lesson to students from the upper surface 64. The height of the ground surface is preferably between 35 and 45 inches and more preferably substantially 40 inches.

Figure 1:
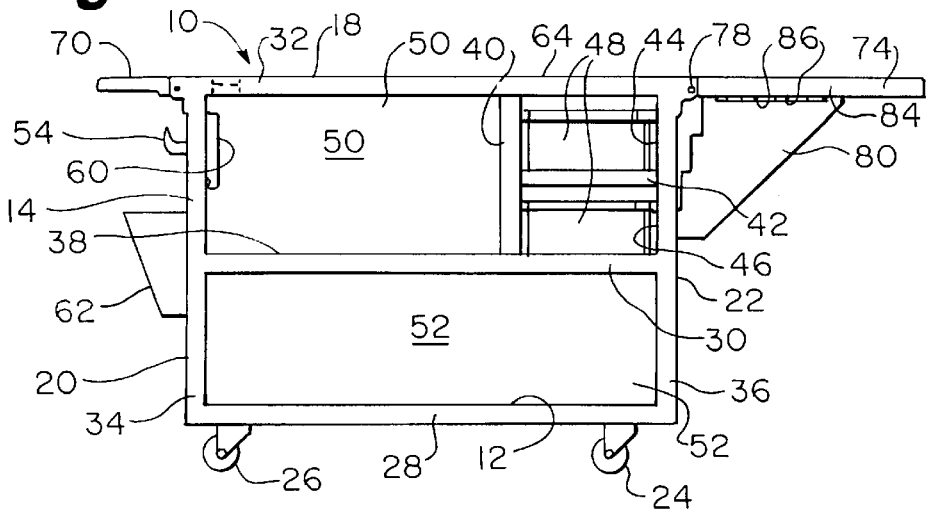
FIG. 1 is a rear elevational view of the mobile teaching station of the present invention with the auxiliary teaching surface in the teaching disposition.
Figure 2:
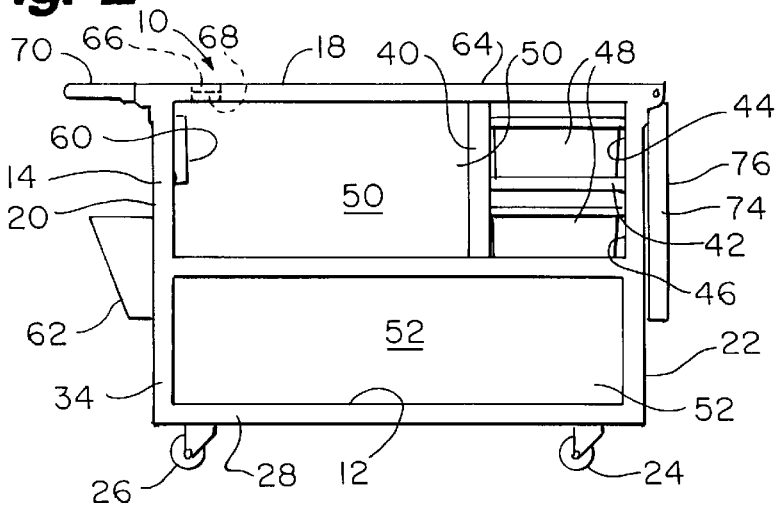
FIG. 2 is a rear elevational view of the mobile teaching station with the auxiliary teaching surface in the folded transport disposition.

Referring to FIGS. 8 and 9, the upper surface 64 of the teaching surface panel 18 has a depression 66 formed therein proximate the side panel 14. The depression 66 is adapted for holding writing instruments, pointers and the like. A bore 68 is in registry with the depression 66 in the depictions of FIG. 1 and FIG. 2. The bore 68 carries through the teaching surface panel 18 so that the power cord of a teaching prop may be fed through the bore 68 then plugged into the power strip 60.

A handle 70 is disposed at the leftwardmost margin of the teaching surface panel 18, as depicted in FIGS. 1–3, and 8–9. The handle 70 is preferably formed integral with the teaching surface panel 18 of the mobile teaching station 10 in a single molding. It should be noted that the handle 70 is positioned at the opposite end of the mobile teaching station 10 from the swiveling castors 24 in order to facilitate steering the mobile teaching station 10 while in transit.

An auxiliary teaching surface panel 74 is disposed at the opposite end of the teaching surface panel 18 from the handle 70. The auxiliary teaching surface panel 74 has a teaching surface 76. The auxiliary teaching surface panel 74 is shiftable between a stored disposition, depicted in FIG. 2, and a teaching disposition, depicted in FIG. 1. In the teaching disposition, the teaching surface 76 of the auxiliary teaching surface panel 74 is substantially coplanar with the upper surface 64 of the teaching surface panel 18.

The auxiliary teaching surface panel 74 is shiftably coupled to the teaching surface panel 18 by a hinge 78 extending substantially parallel with the end margin of the teaching surface panel 18. A pair of generally triangular shaped support members 80 depend from the auxiliary teaching surface panel 74 to support the auxiliary teaching surface panel 74 when in the teaching disposition by engaging the outside surface of the side panel 16. The support members 80 are disposed proximate the front margin 82 and the rear margin 84 of the auxiliary teaching surface panel 74. The support members 80 are coupled by a hinge 86 to the respective front and rear margins 82, 84. The hinge 86 extends substantially parallel to the respective front and rear margin 82, 84. When shifting from the teaching disposition of FIG. 1 to the stored disposition of FIG. 2, the auxiliary teaching surface panel 74 is lifted slightly to disengage the support members 80 from the side panel 16. The support members 80 may then be folded up flush with the underside of the auxiliary teaching surface panel 74 and the teaching surface panel 74 may then be rotated downward about the hinge 78 from the teaching disposition to the stored disposition.

Figure 3:
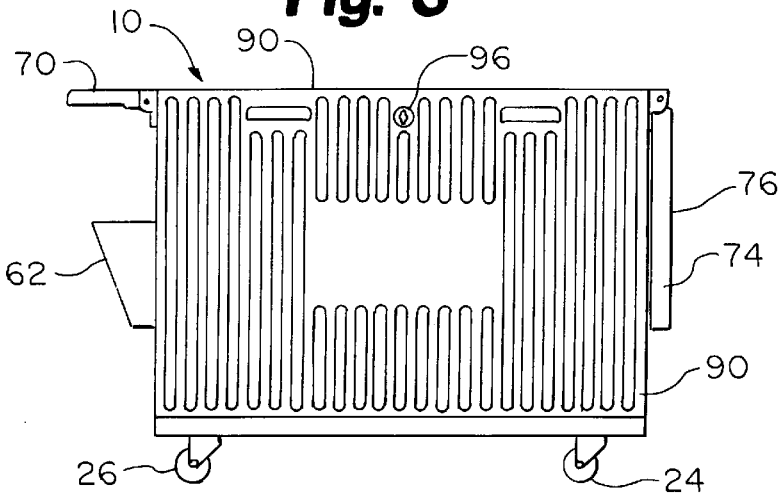
FIG. 3 is a rear elevational view of the mobile teaching station with a security panel in place.
Figure 7:
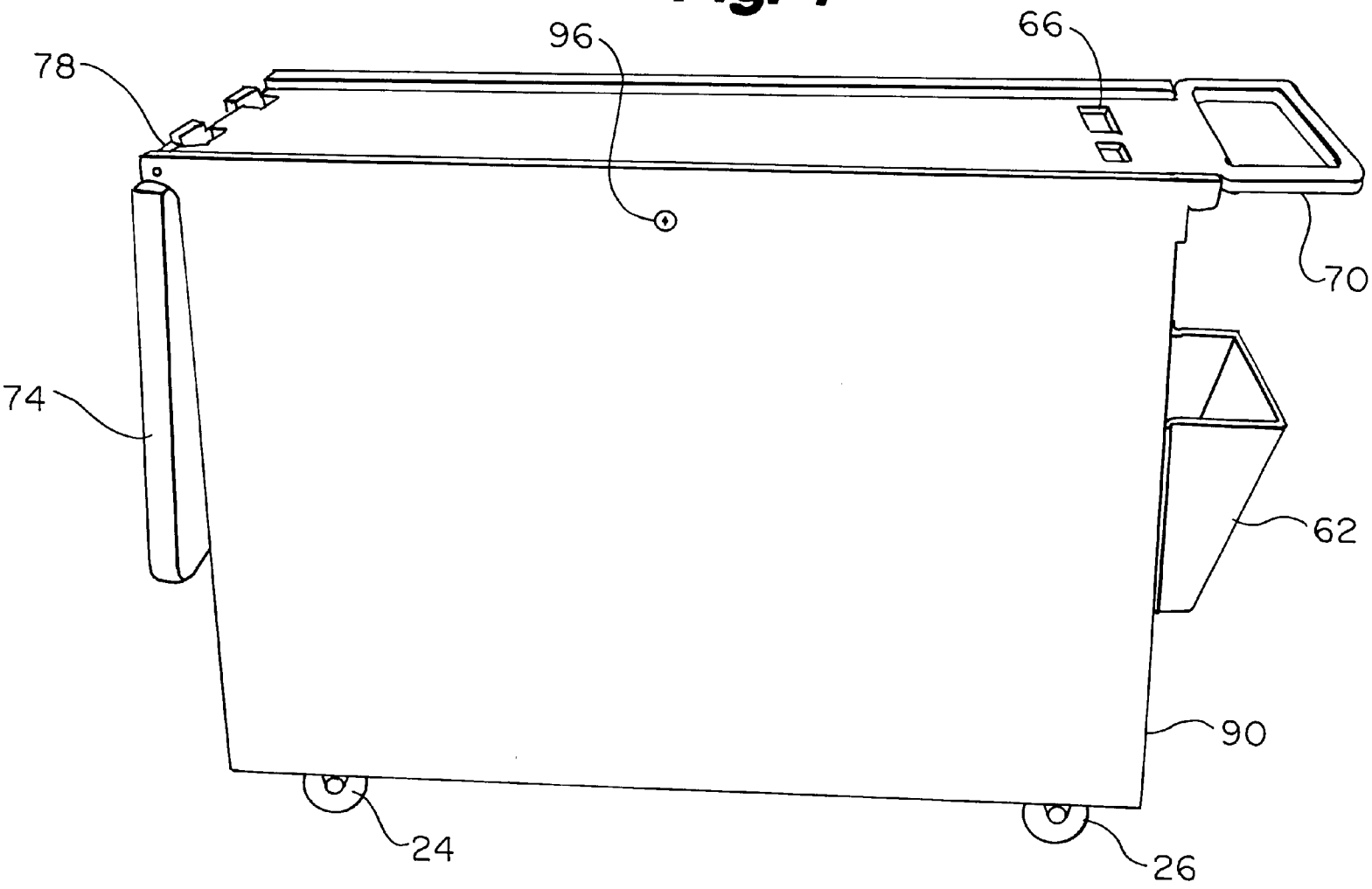
FIG. 7 is a front elevational view of the mobile teaching station with security panel in place.
Figure 10:
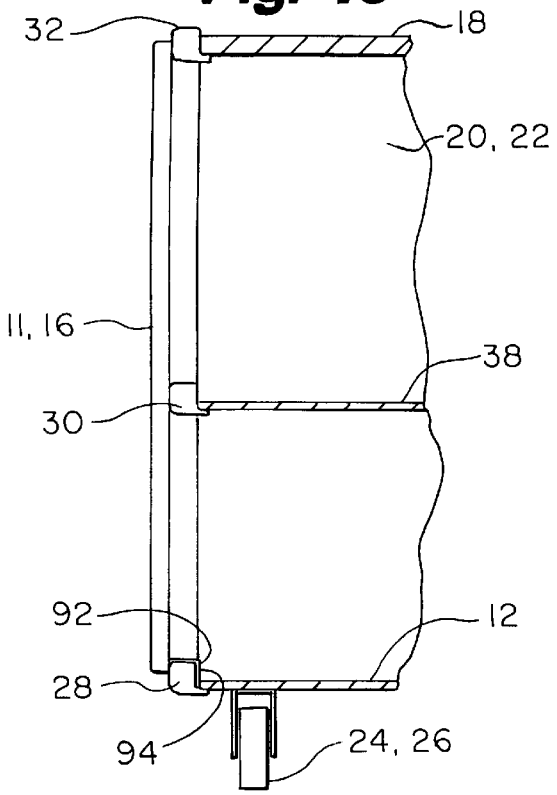
FIG. 10 is a cutaway sectional end view of the interlocking juncture of the security panel and the lower rail.
Figure 11:
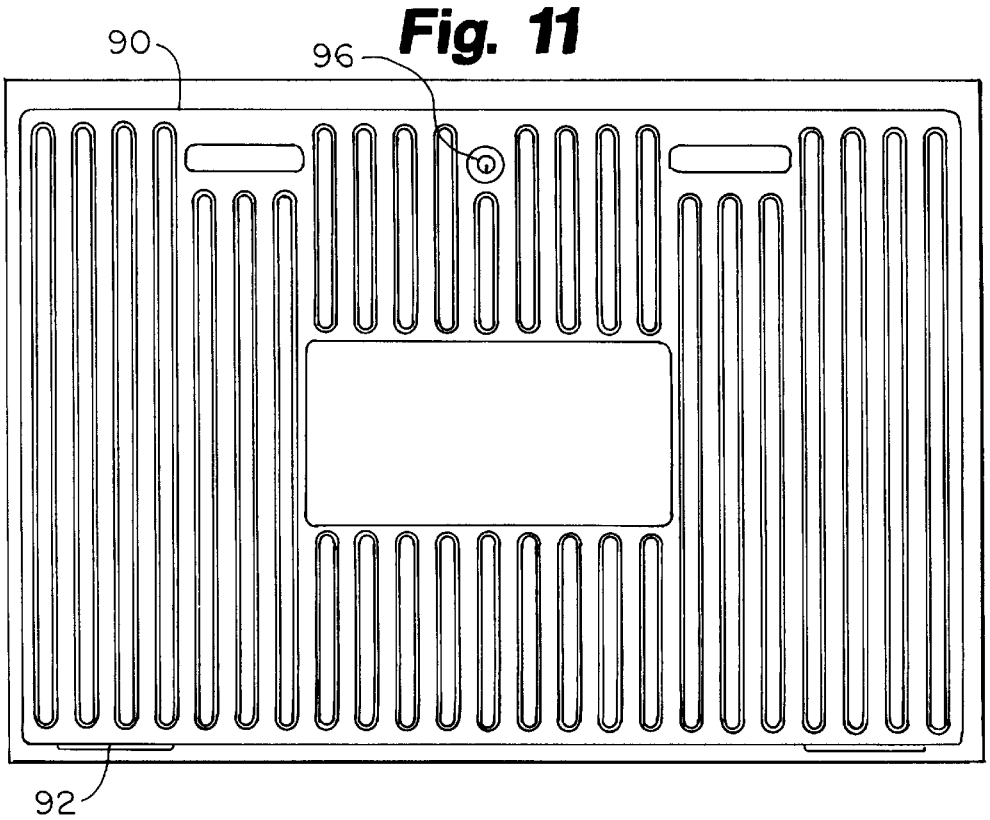
FIG. 11 is a front elevational view of the security panel.

FIGS. 3 and 7 depict the security panel 90 in place on the mobile teaching station 10 and by itself detached from the mobile teaching station in FIG. 11. There are two security panels 90 that are virtually identical: a rear panel 90 as depicted in FIG. 3 and a front panel 90 as depicted in FIG. 7. Each of the security panels 90 is readily attached to the mobile teaching station 10. Referring to FIG. 10, an inwardly directed lip 92 formed proximate the lower margin of the security panel 90 is engaged with the inner margin 94 of the bottom rail 28 of the respective side panels 14, 16. The keyed lock 96 is rotatable, a prong (not shown) of the lock 96 engaging an inner margin (not shown) of the top rail 32 of the respective side panel 14, 16, to secure the security panel 90 to the mobile teaching station 10.

Although a certain specific embodiment of the present invention has been shown and described, it is obvious that many modifications and variations thereof are possible in light of the teachings. It is to be understood therefore that within the scope of the appended claims, the invention may be practiced otherwise than as specifically described herein.

What is claimed is:

1. A mobile teaching station being supportable on an underlying ground surface, comprising:

a bottom shelf panel having an upwardly directed shelf surface for supporting a plurality of teaching props;

a first and a second opposed end panel being substantially orthogonally disposed with respect to the bottom shelf panel, the first end panel being operably coupled to the bottom shelf panel proximate a first end thereof, the second end panel being operably coupled to the bottom shelf panel proximate a second end thereof;

a center shelf panel disposed spaced apart from the bottom shelf panel and having an upwardly directed shelf surface for supporting a plurality of teaching props, the central shelf panel extending between the first and second end panels;

a teaching surface panel extending between a top of the first and second end panels, the teaching surface panel presenting an upwardly directed mobile teaching surface, the mobile teaching surface being designed to support a plurality of teaching props, during instruction of students, at a height above the ground surface for a person to deliver a lesson using teaching props disposed on the mobile teaching surface;

a front opening being peripherally defined by a front side of the bottom shelf panel, the first and second opposed end panels, and the teaching surface panel, and a rear opening being peripherally defined by a rear side of the bottom shelf panel, the first and second opposed end panels, and the teaching surface panel, the front and rear openings providing ready access to teaching props disposed on the bottom shelf upwardly directed shelf surface and the center shelf upwardly directed shelf surface;

means for readily transporting the mobile teaching surface to a desired teaching site being operably coupled to the bottom shelf panel; and auxiliary shelving supported by the center shelf panel and spaced apart therefrom the shelving defining relatively smaller shelf space, the shelf space being uniquely designed to accommodate a selected set of teaching props.

2. The mobile teaching station of claim 1 further including at least one source of electric power being operably coupled thereto and having an electric outlet being readily accessible to the mobile teaching surface.

3. The mobile teaching station of claim 2 wherein the at least one source of electric power is a power cord storable thereon, the power cord being electrically coupled to a power strip disposed proximate the teaching surface and being couplable to an external source of electric power.

4. The mobile teaching station of claim 1 wherein the means for readily transporting the mobile teaching surface includes a plurality of ground engaging wheels and a handle for facilitating steering and pushing the mobile teaching surface.

5. The mobile teaching station of claim 1 further including an auxiliary mobile teaching surface operably coupled with the mobile teaching surface, the auxiliary mobile teaching surface being shiftable from a stored disposition to a teaching disposition, the teaching disposition being substantially co-planar with the mobile teaching surface. wheels and a handle for facilitating steering and pushing the mobile teaching surface.

6. The mobile teaching station of claim 4 wherein the handle for facilitating steering and pushing the mobile teaching surface is formed integral with a component of the mobile teaching station, an upper surface of the component being the teaching surface.

7. The mobile teaching station of claim 1 further including a readily accessible storage facility for relatively small teaching instruments, the storage facility being formed as a depression in the teaching surface.

8. A mobile teaching station being supportable on an underlying ground surface, comprising:

a bottom shelf panel having an upwardly directed shelf surface for supporting a plurality of teaching props;

a first and a second opposed end panel being substantially orthogonally disposed with respect to the bottom shelf panel, the first end panel being operably coupled to the bottom shelf panel proximate a first end thereof, the second end panel being operably coupled to the bottom shelf panel proximate a second end thereof;

a center shelf panel disposed spaced apart from the bottom shelf panel and having an upwardly directed shelf surface for supporting a plurality of teaching props, the central shelf panel extending between the first and second end panels;

a teaching surface panel extending between a top of the first and second end panels, the teaching surface panel presenting an upwardly directed mobile teaching surface, the mobile teaching surface being designed to support a plurality of teaching props, during instruction of students, at a height above the ground surface for a person to deliver a lesson using teaching props disposed on the mobile teaching surface;

a front opening being peripherally defined by a front side of the bottom shelf panel, the first and second opposed end panels, and the teaching surface panel, and a rear opening being peripherally defined by a rear side of the bottom shelf panel, the first and second opposed end panels, and the teaching surface panel, the front and rear openings providing ready access to teaching props disposed on the bottom shelf upwardly directed shelf surface and the center shelf upwardly directed shelf surface;

means for readily transporting the mobile teaching surface to a desired teaching site being operably coupled to the bottom shelf panel; and security means for providing security for the teaching props when the teaching props are stored in the mobile storage facility, the security means for providing security for the teaching props being a first lockable, removable panel being substantially coextensive with the front opening of the mobile teaching station and a second lockable, removable panel being substantially coextensive with the rear opening of the mobile teaching station.

* * * * *

UNITED STATES PATENT AND TRADEMARK OFFICE

CERTIFICATE OF CORRECTION

PATENT NO :6,129,366

DATED :October 10, 2000

INVENTOR(S) :Dettmann et al.

It is certified that error appears in the above-identified patent and that said Letters Patent are hereby corrected as shown below:

Column 2, line 62, delete "prospective" and insert --pespective--.

Column 4, line 18, delete the space between "50" and ",".

Column 5, line 64, after "therefrom" insert --,--.

Column 6, line 21, after "teaching surface." delete "wheels and a . . . teaching surface.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*